United States Patent [19]

Choy

[11] Patent Number: 4,517,052

[45] Date of Patent: May 14, 1985

[54] INTERNAL SIZING WITH BLACK LIQUID

[75] Inventor: Edmund M. Choy, Cloquet, Minn.

[73] Assignee: Westvaco Corporation, New York, N.Y.

[21] Appl. No.: 559,379

[22] Filed: Dec. 8, 1983

[51] Int. Cl.[3] ..... D21D 3/00

[52] U.S. Cl. ..... 162/11; 162/16; 162/180; 162/189

[58] Field of Search ..... 162/10, 11, 14, 16, 162/60, 163, 180, 189

[56] References Cited

U.S. PATENT DOCUMENTS

| | | | |
|---|---|---|---|
| 931,608 | 8/1909 | Hough | 162/14 |
| 1,231,153 | 6/1917 | Haeffner | 162/163 |
| 1,873,056 | 8/1932 | Smith et al. | 162/11 |
| 2,260,557 | 10/1941 | Burton | 162/163 |
| 2,360,779 | 10/1944 | Lang et al. | 162/60 |
| 3,180,787 | 4/1965 | Adams | 162/163 |
| 3,236,720 | 2/1966 | Tousignant et al. | 162/163 |
| 3,305,435 | 2/1967 | Williston et al. | 162/163 |
| 3,454,970 | 7/1969 | Sutherland | 162/60 |
| 3,567,574 | 3/1971 | Braitberg et al. | 162/60 |

*Primary Examiner*—Peter Chin

[57] ABSTRACT

A portion of the spent cooking liquor from a pulping process is diverted from the washing step directly to the machine chest of a paper machine for pre-sizing the paper made on the paper machine. The preferred pulping process is an unbleached kraft or sulfate process and the preferred raw material for the pulping process is pine or softwood chips. Moreover, the preferred point in the washing step for diverting the black liquor is near or at the final washing stage.

3 Claims, 2 Drawing Figures

INTERNAL SIZING WITH BLACK LIQUID

BACKGROUND OF INVENTION

The present invention relates to a novel sizing process and more particularly to a method for the internal sizing of paper using black liquor from a pulping process.

The term "sizing" may be defined as the process in which a chemical additive provides paper and paperboard with resistance to liquid wetting, penetration and adsorption. Because cellulose is a very hydrophilic material and pulp fiber surfaces have a high specific energy, water readily wets these surfaces. The very porous nature of paper makes it act like a sponge, so that unsized paper soaks up aqueous liquids very rapidly and extensively. Such adsorption of water produces deleterious losses in paper properties such as strength and stiffness as measured by the Cobb and Hercules sizing tests. Accordingly, it is an accepted practice to add sizing agents to pulp stock during the manufacture of paper to increase water repellency.

Some of the practical requirements for a sizing agent are, (1) it must produce fiber surfaces having a low degree of wettability by aqueous liquids; (2) a feasible method must be available for attaching the size to the fiber surface; (3) the size must be well distributed over all fiber surfaces to insure adequate water repellancy throughout the paper structure; (4) the molecules of the size must eventually be well anchored to the fiber surfaces or become permanently immobilized in some other way; (5) the size must have a high degree of chemical inertness toward the impinging liquid; and, (6) the size should have no adverse effects on either the paper-making process or the paper product properties.

Examples of sizing materials used in the past include natural material such as tall oil rosin, wood rosin and gum rosin. Other sizing agents and processes include wax and asphalt emulsion sizes and various synthetic sizing agents such as alkyl ketene dimer which are chemically reactive. It is also known that tall oil pitch may be used as a sizing agent. However, the present invention suggests the use of black liquor as a sizing agent for paper, and discloses a method for using the black liquor from a chemical pulping process directly in the machine chest of a paper machine for pre-sizing paper.

SUMMARY OF INVENTION

The present invention relates to a sizing process and more particularly to a combined pulping and sizing process wherein part of the spent cooking liquor from a pulping process is used as an internal size for paper.

It is an accepted practice in the manufacture of paper to add sizing agents to pulp stock in order to increase the water repellency of paper. These sizing agents are known to include natural materials such as wood rosin, gum rosin and tall oil rosin. The rosin sizing of paper has been universally practiced for almost 170 years, and rosin or rosin based products are still the most commonly used sizing material. Both wood rosin and gum rosin are obtained from pine trees, while tall oil rosin is obtained from the fractional distillation of tall oil, a by-product of the sulfate pulping of wood. The rosin sizing process involves the separate addition of rosin and alum to a pulp slurry. The sizing agents are usually added after the pulp is refined, but sufficiently early in the paper-making process to provide uniform distribution in the slurry and adequate time for size precipitate formation and retention. The customary place for adding such sizing agents in a paper-making process is at the machine chest of the paper machine.

In a typical chemical pulping process, the pulp for making paper is comprised of wood chips or the like which are cooked in a digester. The common pulping processes used on wood are classified into soda, sulfate (kraft), acid sulfite and neutral sulfite.

In the kraft or sulfate pulping process, wood chips are cooked under heat and pressure with a cooking liquor of sodium hydroxide and sodium sulfide to remove lignin and other wood constituents from the cellulose. This highly alkaline environment forms soluble soaps of the resin and fatty acids present in the wood. The spent cooking liquor from the digesters plus the filtrate from the pulp washers is commonly known as black liquor. Black liquor contains practically all of the cooking chemicals originally added together with over half the original weight of wood. In some paper mills part of the black liquor is used for charging the digesters where it acts as a diluent for fresh liquor. In such cases, recycled liquor may comprise from 20–50% of the total liquor volume. However, in the kraft or sulfate pulping process, the combined black liquor from the pulp washers is concentrated and separated, where crude tall oil and lignin fractions are removed to make specialty chemical products. For instance, the subsequent fractional distillation of the crude tall oil products produces a very light colored rosin which is quite suitable for the sizing of high brightness paper and paperboard.

Thus it may be seen that pulping and sizing processes are distinct processes used in the manufacture of paper. It is also apparent that materials useful as sizing agents may be manufactured from extracts of the cooking liquors used to make pulp. However, in accordance with the present invention, a portion of the black liquor from the washing step of the pulping process is diverted and used directly in the process for manufacturing paper. Accordingly, it is an object of the present invention to divert a portion of the black liquor from a pulp washing step directly to the machine chest of a paper machine for pre-sizing the paper.

It is a more specific object of the present invention to divert a portion of the black liquor from the washer of an unbleached kraft pulping process into the machine chest of a paper machine to pre-size the paper made on the paper machine.

Another object of the present invention is to utilize the black liquor from a pulping process in the machine chest of a paper machine as a means for reducing the amount of size normally added to the machine chest.

The present invention is preferably practiced in unbleached pulping systems where the color of the black liquor is not objectionable. Moreover, the preferred point for diverting the black liquor is near the end of the washing process where most of the surfactants and other related products which could negate the sizing effect of the black liquor have been removed. In a typical counter current, staged washer system, the black liquor is diverted from the final washer stage directly into the machine chest.

The amount of rosin present in the black liquor depends generally upon at least three variables, including, (1) the point in the washing step where the black liquor is sampled;

(2) the type of wood chips pulped, i.e., hardwood or softwood; and, (3) the efficiency of the washers.

For example, the black liquor taken from the third stage washer of a typical kraft pulping process using 100% hardwood has a rosin content on the order of about 0.02% as measured by gas chromatographic (GC) analysis. Black liquor obtained from the same source using 100% softwood has a rosin content on the order of from about 0.08–0.23% rosin. The GC rosin concentration is a measure of the dehydroabietic acid fraction of the sample and it is noted that at least two commercially available sizing agents, MONSIZE dispersed size supplied by Monsanto Corp. and STAFOR dispersed size supplied by Westvaco Corporation, both are predominantly composed of the dehydroabietic acid fraction of rosin. Since the rosin content of softwood black liquor is considerably higher than that of hardwood black liquor, the present invention could be practiced successfully in any paper mill using a softwood furnish or, a combination of hardwood and softwood in the furnish.

With the foregoing purposes, features and advantages in view, the invention is described in greater detail hereafter in the Detailed Description taken with the accompanying drawing.

IN THE DRAWING

FIG. 1 is a schematic view illustrating a typical pulping process including the novel feature of the present invention; and, FIG. 2 is a schematic view in more detail illustrating the washing stage of a typical pulping process including the novel feature of the present invention.

DETAILED DESCRIPTION

Figure 1:
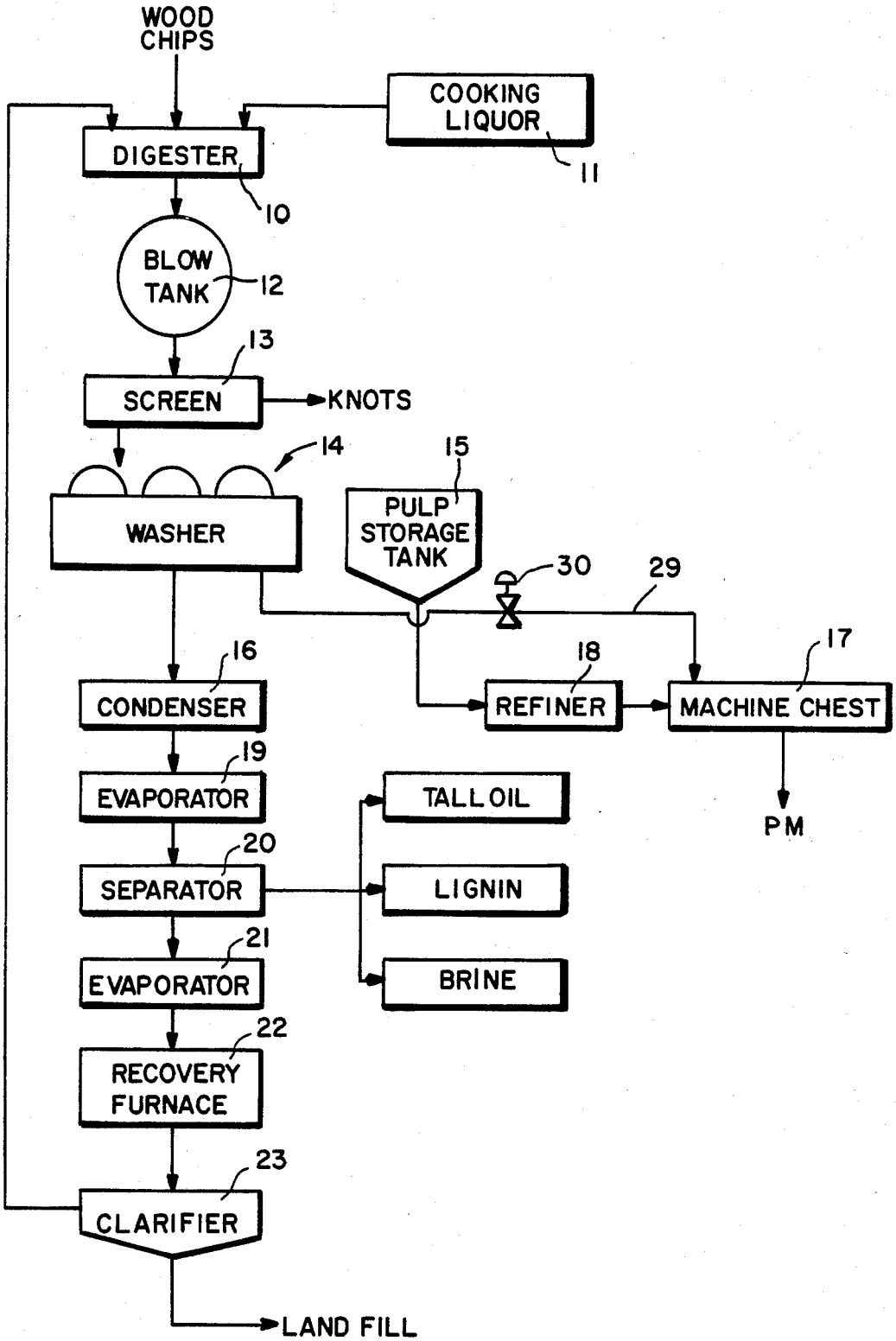

Referring now to FIG. 1 of the drawing, there is illustrated schematically a process by which a portion of the black liquor from an unbleached pulping process may be diverted directly to the machine chest of a paper machine for pre-sizing the paper made on the paper machine.

The digester is indicated schematically at 10. Wood chips or other source of cellulosic material is charged into the digester 10 and fresh cooking liquor is introduced from a storage tank 11. Digestion is carried out under such conditions of temperature and pressure as are normally employed in a typical pulping process. The character of the cooking liquor employed depends upon the type of pulping process. In the kraft process, the primary cooking chemicals are sodium hydroxide and sodium sulfide. After digestion has been completed, the contents of the digester are blown into a blow tank 12 and passed through a screen 13 where knots and the like are removed. After being screened, the pulp is directed to a washer 14 which is preferably of the multiple stage type. During the washing step, the pulp is washed free of spent cooking liquor (black liquor) and directed to a pulp storage tank 15, while the waste liquor is conducted to a condenser 16 for treatment and recovery. However, in the present invention, a part of the black liquor is diverted from the washer 14 directly to the machine chest 17.

Referring once again to FIG. 1, under normal conditions, the pulp from the washers is directed to a pulp storage tank 15 and refiner 18 before entering the machine chest 17. In the present invention the pulp takes the same path. Meanwhile, in like manner, the waste liquor from the washers 14 in both a conventional pulping process and the present invention is directed to a recovery stage including condenser 16 and other recovery steps. In general, the black liquor after being condensed is passed to an evaporator 19 and a separator 20 before being further evaporated at 21. In the separator 20, different fractions of the black liquor are isolated using solvent or distillation processes to produce useful chemical products. After the second evaporator 21, the remainder of the black liquor is burned in a recovery furnace 22 to recover available heat, and the residue from the furnace 22 is finally clarified at 23. Generally, upon clarification, a top fraction may be obtained which is chemically treated before being recycled back to the digester 20 for use as make-up cooking liquor and the dregs from the clarifier are disposed of at a landfill.

Figure 2:
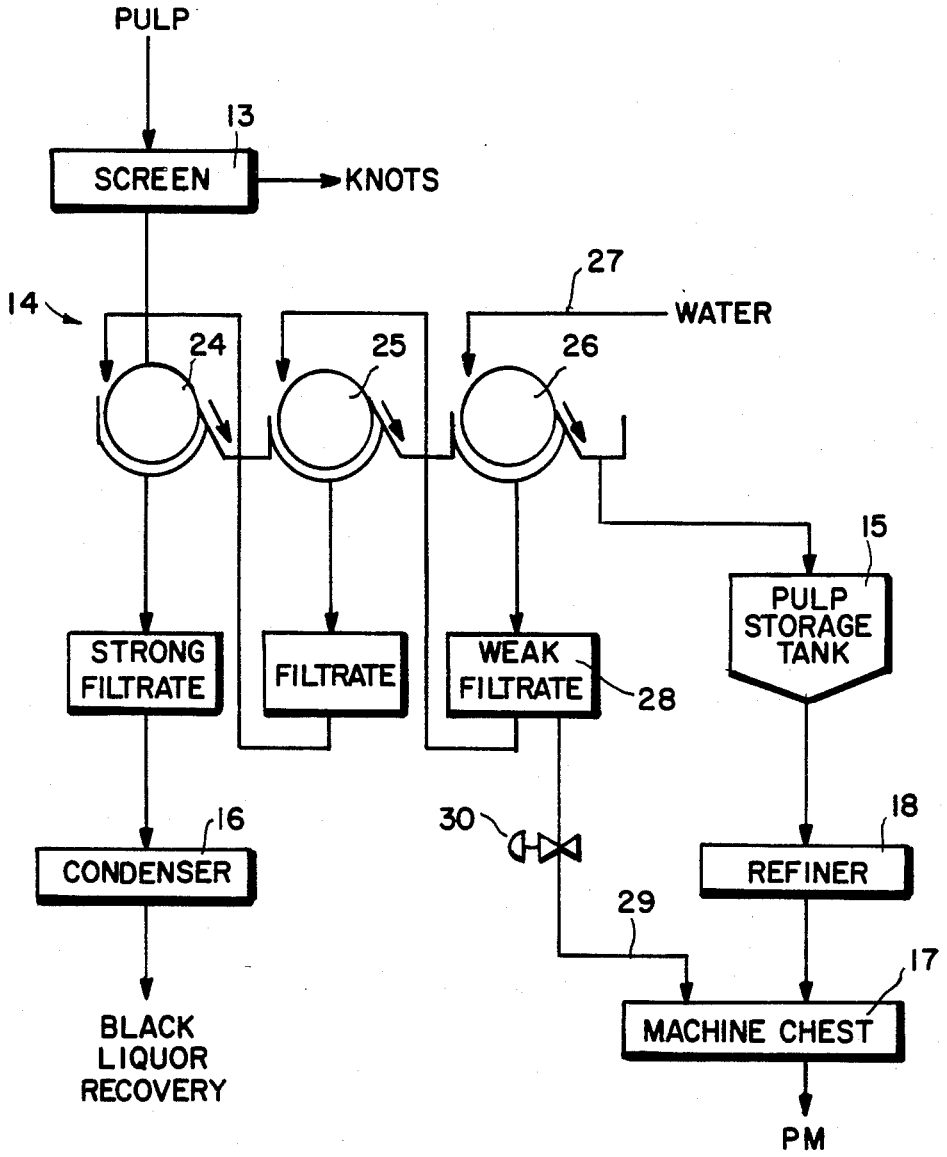

FIG. 2 shows in more detail a schematic version of the washing step where a portion of the black liquor filtrate is diverted to the machine chest to pre-size the pulp before it goes to the paper machine (PM). A three stage counter current washing process is illustrated with pulp coming from screen 13 being directed to a first stage 24 of washer 14. The pulp in first stage 24 is washed with filtrate taken from the second stage 25 and pulp at the second stage 25 is washed with filtrate taken from the third stage 26. The strong filtrate from first stage 24 constitutes the spent pulping liquor that is directed to condensor 16 and beyond for black liquor recovery, and the pulp at the third stage 26 is washed with dilution water added as wash water at 27. Meanwhile, the washed pulp from the third stage of washer 14 is conducted to a pulp storage tank 15 before being refined at 18 and added to the machine chest 17 of the paper machine (PM). This is the normal process used with a conventional counter current washing step in the manufacture of pulp. However, in accordance with the present invention, some of the weak black liquor filtrate 28 from the third stage 26 of washer 14 is diverted at 29 and added directly to the machine chest to pre-size the pulp. The black liquor filtrate diverted is made up by adding an equal amount of water to the shower at 27 of the third stage washer 26. The flow of black liquor filtrate diverted at 29 can be controlled either manually or automatically by a suitable valve 30 in the line between the weak filtrate tank 28 and the input 29 to machine chest 17. The flow may be made to depend upon the sizing demand of the paper machine or on other variables as desired.

It will be understood that the apparatus used in the process described hereinbefore, and schematically illustrated, will include the necessary auxiliary equipment such as pumps, valves, vents, motors and the like to enable the various procedures to be carried out. Further, in order to validate the efficacy of the present invention, the following example demonstrates the results obtained by practicing the present invention.

EXAMPLE I

To confirm the presence of sizing components associated with the residual black liquor in the pulp mat taken from a washer drum, handsheets were formed with laboratory washed pulp containing no black liquor and laboratory washed pulp with black liquor added back to its original level in the pulp mat (about 85% weight-on-weight of wet mat). The laboratory washed pulp was obtained by washing and filtering both pine and hardwood pulps with tap water. Each handsheet was formed with 5 gm. of pulp, 1.6% sulfuric acid on O.D. (oven dried) pulp and 0.5% alum on O.D. pulp. The final pH of 5.5 was achieved by addition of sulfuric acid or sodium hydroxide. The wet handsheets were pressed and dried at 240 degrees F. Handsheets were then conditioned at 50% RH and 73 degrees F. for 24 hours prior to testing. Internal sizing was measured using a 10% formic acid solution for the Hercules size test. The solutions were added to the smooth side of the handsheets.

In the handsheets containing either 100% hardwood or pine, the internal sizing was significantly higher in the washed pulp containing black liquor as shown in Table I. The rosin content of the pine black liquor (0.14%) was seven times higher than the CG rosin content of the hardwood black liquor (0.02%). The GC rosin content of the laboratory washed pine and hardwood pulps was 0.01% and 0.02%, or substantially equivalent.

TABLE I

Effect of Black Liquor on Internal Sizing

| Internal Size Tests | Conditions | |
|---|---|---|
| | 100% Hardwood | 100% Pine |
| Washed Pulp (Tap Water) Hercules (sec.) | 7 | 51 |
| Washed Pulp (Black Liquor) Hercules (sec.) | 53 | 1275 |
| Black Liquor (GC Rosin %) | 0.02 | 0.14 |
| Washed Pulp (GC Rosin %) | 0.02 | 0.01 |

While only a single embodiment of the present invention has been described in detail, it will be understood that other embodiments or modifications for other pulping processes are within the scope of the invention as defined in the appended claims. The apparatus and procedures specified for the various steps are to be understood as being merely illustrative and not restrictive.

What is claimed is:

1. A method for manufacturing unbleached, presized paper comprising the steps:

(a) cooking wood chips or the like in a digester to delignify the wood chips;

(b) discharging the cooked chips into a blow tank to make pulp;

(c) screening the pulp to remove knots and the like;

(d) washing the pulp in a multiple stage washer to remove the cooking liquor from the pulp;

(e) directing the washed pulp to a pulp storage tank for use in the machine chest of a papermachine; and, (f) directing the wash water containing the spent cooking liquor to a distillation process where it is concentrated and separated, the improvement wherein a portion of the wash water from the final stage of the washing step is diverted without further treatment to the machine chest of a papermachine to pre-size the washed pulp, said diverted wash water containing from about 0.08–0.23 weight percent rosin.

2. The method of claim 1 wherein the wood chips are softwood and the cooking process is a sulfate cook.

3. The method of claim 2 wherein the amount of wash water diverted to the machine chest of the papermachine depends upon the sizing demand of the papermachine.

* * * * *